US009380864B2

(12) United States Patent
Höltschi et al.

(10) Patent No.: US 9,380,864 B2
(45) Date of Patent: Jul. 5, 2016

(54) FURNITURE ITEM WITH A VERTICALLY ADJUSTABLE LEG

(71) Applicant: USM Holding AG, Muri bei Bern (CH)

(72) Inventors: Niklaus Höltschi, Niederönz (CH); Alexander Schaerer, Muri b. Bern (CH); Thomas Dienes, Bern (CH)

(73) Assignee: USM HOLDING AG, Muri Bei Bern (CH)

( * ) Notice: Subject to any disclaimer, the term of this patent is extended or adjusted under 35 U.S.C. 154(b) by 0 days.

(21) Appl. No.: 14/542,768

(22) Filed: Nov. 17, 2014

(65) Prior Publication Data

US 2015/0136000 A1 May 21, 2015

(30) Foreign Application Priority Data

Nov. 18, 2013 (EP) ..... 13405130

(51) Int. Cl.
*A47B 9/00* (2006.01)
*A47B 9/08* (2006.01)
*A47B 9/20* (2006.01)

(52) U.S. Cl.
CPC .. *A47B 9/083* (2013.01); *A47B 9/20* (2013.01)

(58) Field of Classification Search
CPC ..... A47B 9/083; A47B 9/20; A47B 9/12; F16B 7/14; F16B 7/1409
USPC ..... 108/146, 147, 147.19, 148
See application file for complete search history.

(56) References Cited

U.S. PATENT DOCUMENTS 3,217,672 A * 11/1965 Haughey ..... A47B 9/12 108/106
3,323,818 A * 6/1967 Winchell ..... F16B 7/14 285/307
3,999,492 A * 12/1976 Emrick ..... A47B 9/083 108/146
4,601,246 A * 7/1986 Damico ..... A47B 9/083 108/146

(Continued)

FOREIGN PATENT DOCUMENTS

DE 3634059 A1 4/1988
DE 4202789 C1 5/1993

(Continued)

*Primary Examiner* — Hanh V Tran
(74) *Attorney, Agent, or Firm* — Birch, Stewart, Kolasch & Birch, LLP

(57) ABSTRACT

The present disclosure relates to an item of furniture, in particular a table, having at least one length-adjustable leg. The length-adjustable leg includes a first telescopic element which is realized as a hollow body, as well as a second telescopic element which is mounted inside the first telescopic element so as to linearly displaceable along a first axis. A locking device which is arranged on the second telescopic element comprises at least one first pin which is movable using an actuating device from a first position, in which the at least one first pin prevents the movement of the first telescopic element relative to the second telescopic element as a result of a force-fitting connection or form-fitting connection, into a second position in which the displacement is not prevented. In addition, the locking device has at least one second pin which is movable by the actuating device from a first state, where the at least one second pin is pressed against an inside surface of a wall of the first telescopic element in order to brace the second telescopic element in relation to the first telescopic element, and a second state where the at least one second pin is at a spacing from the wall of the first telescopic element.

12 Claims, 5 Drawing Sheets

(56) References Cited

U.S. PATENT DOCUMENTS

| | | | | | |
|---|---|---|---|---|---|
| 4,607,577 | A * | 8/1986 | Leonardo | A47B 9/083 | 108/146 |
| 4,850,563 | A * | 7/1989 | Grout | A47B 9/06 | 108/147 |
| 5,706,739 | A * | 1/1998 | Shaheen | A47B 9/02 | 108/146 |
| 5,924,658 | A * | 7/1999 | Shiery | A61M 5/1415 | 248/125.8 |
| 6,299,113 | B1 * | 10/2001 | Yamashita | A47B 9/20 | 248/161 |
| 6,412,427 | B1 * | 7/2002 | Merkt | A47B 9/12 | 108/147 |
| 6,435,112 | B1 * | 8/2002 | Insalaco | A47B 9/083 | 108/147.21 |
| 8,146,876 | B1 * | 4/2012 | Young | F16B 7/1409 | 248/161 |
| 2002/0195411 | A1 | 12/2002 | Liu | | |
| 2003/0136885 | A1 * | 7/2003 | Malizia | A16B 7/1409 | 248/125.8 |
| 2004/0206879 | A1 * | 10/2004 | Steyn | A16B 2/246 | 248/440 |
| 2005/0279261 | A1 * | 12/2005 | Lo | A47B 9/083 | 108/147 |
| 2006/0130713 | A1 * | 6/2006 | Jones | A47B 9/00 | 108/106 |
| 2010/0089854 | A1 * | 4/2010 | Keyvanloo | A47B 9/083 | 211/183 |
| 2011/0203496 | A1 * | 8/2011 | Garneau | A47B 9/20 | 108/147 |
| 2013/0126695 | A1 * | 5/2013 | Baas | E04G 25/08 | 248/354.1 |
| 2013/0175419 | A1 * | 7/2013 | Wheeler | F16B 7/1409 | 248/354.1 |
| 2013/0214111 | A1 * | 8/2013 | Bishop | F16B 7/14 | 248/354.1 |

FOREIGN PATENT DOCUMENTS

| | | | |
|---|---|---|---|
| DE | 19749494 | A1 | 5/1999 |
| DE | 19856864 | A1 | 6/2000 |
| DE | 102009045707 | A1 | 4/2011 |
| EP | 1827170 | A2 | 9/2007 |
| FR | 2844165 | A1 | 3/2004 |
| GB | 2483876 | A | 3/2012 |
| LU | 90876 | A2 | 8/2003 |
| WO | WO 2013/053748 | A1 | 11/1999 |
| WO | WO 2006/066116 | A2 | 6/2006 |

* cited by examiner

FURNITURE ITEM WITH A VERTICALLY ADJUSTABLE LEG

TECHNICAL SCOPE

The invention relates to furniture items, in particular tables, having at least one vertically adjustable leg.

PRIOR ART

Vertically adjustable furniture items, in particular vertically adjustable work tables, are known in the field.

For example, U.S. Pat. No. 5,706,739 (Ergotech Inc.) describes a vertically adjustable work table where a work surface is supported on two rectangular telescopic legs. The telescopic legs have two telescopic elements each which can be displaced relative to one another. A drive, which has a toothed wheel in the region of each of the two telescopic legs, is driven by means of a crank. The toothed wheels engage in a toothed rod which is arranged in the two upper telescopic elements. The telescopic elements are mounted next to one another by means of an arrangement of four rollers. The telescopic elements can be fixed relative to one another by means of a locking device where a slide blocks the rotation of one of the toothed wheels.

WO 2006/066116 (Steelcase Development Corp.) discloses mechanically vertically adjustable tables, in particular with only one foot, a safety lock and preferably an adjustable counterweight being present. The tables include a two-part telescopic leg with a force balancing mechanism arranged therein which comprises, among other things, a wire, the ends of which are fastened on the first or second telescopic part, and a force generator, the preliminary tension of which is adjustable. The telescopic parts are mounted next to one another by means of rollers, as a result of which the friction is reduced. In addition, a lock is present which includes a threaded rod and a sleeve that interacts therewith. By means of a corresponding mechanism which is actuated via an actuating cable by means of a lever, the sleeve can be secured with reference to its rotation in relation to the threaded rod. A safety device, which prevents vertical adjustment entirely where forces acting on the table top are too high, is also created by means of two compression springs.

LU 90876 (Deceuninck N. V) relates to a vertically adjustable support column for supporting a table top which is realized as a two-part telescope. An assembly plate, which extends inside the column and with which at least one spring-loaded locking plate is coupled in an articulated manner, is connected to the upper telescopic part such that a lip thereof is able to engage into one of many recesses arranged one on top of another in the lower telescope part. In addition, means for the pivoting of the locking plate are present in order to enable displacement of the two telescopic parts with respect to one another. Said latter means include in particular a cable which is connected to the locking plate and extends in the column up to the upper end thereof and then further to the outside and is provided on its corresponding end with an actuating member.

DE 197 49 494 (R. Schmidt) relates to a vertically adjustable work table with at least three support legs, which are arranged spaced apart from one another and are length-adjustable by means of a common drive for receiving a work top, each support leg consisting of an outer tube and at least one inner tube which is displaceable relative thereto. The inner tube is guided in the outer tube so as to be axially displaceable by means of guide rings. The length of the support legs can be extended by means of a tension member each. The end of a tension members is fastened on a cap of the inner tube. The tension members of all of the support legs are guided to a tension unit and there run via guide rollers to a rotatably mounted drum with helical channels for receiving the tension members. The drum can be arranged with a perpendicular axis below the work top. It is driven manually or by motor for adjusting the height of the table. The support legs can be locked at a specific height by means a self-locking system of the drive.

DE 198 56 864 discloses a table frame with an upper frame, which is mounted in relation to the foot frame by means of at least two telescopic guides and is vertically adjustable and lockable, the adjusting being effected by means of manually actuatable threaded spindles which are synchronized with one another. Toothed wheels, which are connected to a driving toothed wheel by means of a chain or a toothed belt, are arranged on the threaded spindles. An actuating mechanism with a locking device is coupled to the driving toothed wheel. In a preferred manner, connected to the driving toothed wheel is a driving drum, a driving jaw cooperating with the circumference of said driving drum, which is actuatable by means of a push rod in the circumferential direction against the force of a spring via a cable pull. A brake shoe cooperates releasably with the circumference of the driving drum for locking. In addition, for reducing the weight load of the upper frame, a spiral spring is advantageously coupled with the driving toothed wheel or the driving drum, the fastening point of the spiral spring and consequently the preliminary tension thereof is adjustable as a result of an adjustable fastening element.

The vertically adjustable tables known in the prior art comprise the disadvantage that on account of the roller guides the telescopic legs have to be dimensioned so as to be relatively large and that the known locking devices, which fix the telescopic legs at a certain length, are able to lock a table top so that it is only flexible and stable to a certain extent.

REPRESENTATION OF THE INVENTION

It is the object of the invention to create a furniture item which is associated with the technical scope named in the introduction with a vertically adjustable leg which comprises as narrow a development of the leg as possible and a smooth-running vertical adjusting system, the furniture item being able to be locked in a flexible and sturdy manner at a certain height.

The achievement of the object is defined by the features of claim 1. According to the invention, a furniture item comprises at least one length-adjustable leg which includes a first telescopic element which is realized as a hollow body as well as a second telescopic element which is mounted inside the first telescopic element so as to be linearly displaceable along a first axis. A locking device is arranged on the second telescopic element. The locking device comprises at least one first pin which is movable by means of an actuating device from a first position, in which the at least one first pin prevents the movement of the first telescopic element relative to the second telescopic element as a result of a force-fitting connection or form-fitting connection, into a second position in which the displacement is not prevented. In addition, the locking device has at least one second pin which is movable by the actuating device from a first state, where the at least one second pin is pressed against an inside surface of a wall of the first telescopic element in order to brace the second telescopic element in relation to the first telescopic element, and a second state where the at least one second pin is at a spacing from the wall of the first telescopic element.

The furniture item is preferably a table, in particular a work table, having a substantially even work surface. As an alternative to this, the furniture item can be a chair, sideboard, shelf, body or the like. In principle, all types of furniture items that are developed so as to be vertically adjustable can be developed according to the present invention.

In a preferred manner, the at least one length-adjustable leg comprises a round cross section. As an alternative to this, however, the at least one length-adjustable leg can also comprise a square, rectangular or arbitrarily polygonal cross section.

The furniture item preferably has two length-adjustable legs. Depending on the size or development of the furniture item, it can also have more than two length-adjustable legs, in particular four or more length-adjustable legs. As an alternative to this, however, a furniture item can have just one length-adjustable leg, e.g. when the furniture item is a stool, a bistro table or the like. The at least one vertically adjustable leg, in a further preferred manner, has arms or a base plate in order to be able to place the vertically adjustable leg in a flexible and sturdy manner on a base, such as for example the floor of a room.

The second telescopic element is arranged in the first telescopic element and is movable along a first axis relative to said second telescopic element. The first telescopic element and the second telescopic element overlap accordingly in that region in which the second telescopic element is received inside the first telescopic element.

The first axis is preferably arranged in such a manner that it is substantially normal with respect to the surface of the base on which the furniture item stands. The relative movement of the two telescopic elements of the at least one vertically adjustable leg is preferably driven by means of a corresponding mechanism. For this purpose, the furniture item preferably has, for example, a hand crank by way of which a user is able to move the two telescopic elements of the at least one length-adjustable leg relative to one another in both directions along the first axis. The transmission of the movement of the crank to at least one of the telescopic elements is preferably effected by means of a cable pull. In a preferred manner in particular, the mechanism additionally has a device which compensates for the specific weight of the furniture item, such as, for example, a spring force that acts in opposition to the direction of the specific weight force, in order to enable as smooth-running a length adjustment as possible of the at least one length-adjustable leg. Said spring force can preferably be varied, for example by means of a change in length of a spring via a crank, in order to enable compensation of the specific weight force to be adapted in an individual manner. However, as an alternative to this, it is also possible to provide an electric motor which enables particularly simple length adjustment of the at least one length-adjustable leg. As a further alternative to this, it is also possible not to provide any mechanism at all and the length adjustment to be effected purely by the user lifting the furniture item.

The at least one first pin preferably engages in a structure of the first telescopic element in terms of a form-fitting connection. For example, the at least one first pin has a surface with teeth which engages in a corresponding surface with complementary teeth inside the first telescopic element. As an alternative to this, the at least one first pin can also prevent relative displacement of the telescopic elements in relation to one another by means of a pure force-fitting connection. In particular, in the case of a purely force-fitting design, a surface of the at least one first pin, as well as a face of the first telescopic element on which the at least one first pin engages, is provided with surfaces which comprise a high degree of static friction relative to one another.

As a result of the form-fitting or force-fitting locking of the second telescopic element relative to the first telescopic element, reliable fixing of the at least one length-adjustable leg is made possible at a certain length adjustment.

In a particularly preferred manner, the locking device has more than only one first pin, in particular two first pins which are able to enter into a force-fitting connection or form-fitting connection with the first telescopic element for example on two opposite sides of the second telescopic element.

In the second position, the at least one first pin is preferably at a spacing from the first telescopic element or from a surface inside the first telescopic element, as a result of which there is no force-fitting or form-fitting connection to the first telescopic element. As a result, the second telescopic element can be moved freely in both directions along the first axis relative to the first telescopic element.

In order to prevent the two telescopic elements from sliding apart from one another, a stop is preferably provided which defines the movement of the second telescopic element relative to the first telescopic element. Said defining accordingly defines the maximum length of the at least one length-adjustable leg. Equally a further stop can be provided in order to define a maximum overlap between the second telescopic element and the first telescopic element. Said second stop accordingly defines the shortest length of the length-adjustable leg.

If the furniture has more than just one length-adjustable leg, the actuating device is preferably developed in such a manner that by way of said actuating device the at least one first pins and the at least one second pins of all the length-adjustable legs present are able to be actuated at the same time. This simplifies the handling when adjusting the height of a furniture item according to the invention.

The at least one second pin presses against an inside surface of the wall of the first telescopic element in the first state. As a result of the force by way of which the at least one second pin presses onto the first telescopic element, the second telescopic element is braced in relation to the first telescopic element. This means that possible play between the first and the second telescopic element is prevented as a result of the bracing of the two telescopic elements in relation to one another. As a result, the second telescopic element is fixed in a flexible and sturdy manner in relation to the first telescopic element. Lateral movements of the furniture item possibly caused by play between the two telescopic elements can be reliably prevented in this manner.

Compared to length-adjustable legs where a telescopic element is guided entirely by means of rollers inside a further telescopic element, the solution according to the invention offers fixing which is just as flexible and sturdy, however with a clearly smaller space requirement as the rollers can be replaced by space-saving sliding bearings. This enables the creation of furniture items with length-adjustable legs which are narrow but nevertheless move in a more flexible and sturdy manner.

The at least one first pin is preferably mounted in the locking device in such a manner that it is movable along a second axis which is substantially at right angles to the first axis. In this case, a movement of the actuating device in opposition to a first resetting force into a first direction along the first axis from a locked position into an unlocked position is converted by means of a first sliding block into a movement of the at least one first pin along the second axis from the first position to the second position.

As a result of using a sliding block, a movement of the actuating device along the first axis, that is along the axis in which the relative movement of the two telescopic elements is effected with respect to one another, can be converted in a particularly simple and reliable manner into a movement along a second axis which is substantially at right angles to the second axis.

As a result of the arrangement of the second axis substantially at right angles to the first axis, a reliable form-fitting or force-fitting connection can be generated between the at least one first pin and the first telescopic element.

Within the framework of said application "substantially at right angles" means an enclosed angle of 90° plus/minus a maximum deviation of 5°.

The bearing arrangement of the at least one first pin in the locking device is preferably effected as a result of an arrangement of the at least one first pin in a linear guide, in particular in a groove or recess of the locking device.

As a result of providing the first resetting force which is generated, for example, by a helical spring, the at least one first pin is automatically pushed into the first position. As a result, the actuating device can be developed in such a manner that it exerts a pulling force only into the first direction as the movement of the actuating device into the second direction and consequently the movement of the at least one first pin from the second position into the first position is effected as a result of the resetting force. In addition, as a result of the resetting force the at least one first pin can be acted upon with an adequately high force in order to ensure a reliable form-fitting or force-fitting connection to the first telescopic element.

The actuating device has a locked and unlocked position, in the unlocked position the at least one first pin is situated in the second position and the at least one second pin is situated in the second state, whilst in the locked position the pins are situated in the first position or in the first state. When the actuating device is situated accordingly in the unlocked position, the length of the at least one length-adjustable leg can be modified, i.e. the two telescopic elements move relative to one another. If the actuating device, however, is situated in the locked state, the two telescopic elements are locked together and the length of the length-adjustable leg cannot be modified.

The actuating device is preferably actuated by means of a lever such that it can be moved from the locked position into the unlocked position. The actuating device preferably has a transmitting element such as, for example, a wire, a chain or the like, by way of which a force can be transmitted at least to the first sliding block.

In a preferred manner, the at least one second pin is mounted in the locking device in such a manner that it is movable along a third axis which is substantially at right angles to the first axis and preferably at right angles to the second axis. A movement of the actuating device in opposition to a second resetting force, which acts on the second pin, from the locked position into the unlocked position is converted by means of a second sliding block into a movement of the at least one second pin along the third axis from the first state to the second state.

As a result of the movement of the at least one third pin along a third axis which is substantially at right angles to the first axis, it is possible to achieve a greatest possible degree of bracing of the two telescopic elements with respect to one another. As a result of preferably arranging the third axis substantially at right angles to the second axis, along which the at least one second pin is moved, it is possible to achieve improved flexibility and sturdiness of movement compared to if the at least one second pin were to move along the same second axis as the at least one first pin. As the form-fitting or force-fitting connection of the at least one first pin already ensures a certain flexibility and sturdiness of movement along the second axis, more flexible and sturdy locking between the second telescopic element and the first telescopic element can also be achieved additionally along the third axis as a result of the bracing. All in all, more flexible and sturdy locking of the two telescopic elements with respect to one another in all directions can be realized in this way.

The bearing arrangement of the at least one second pin in the locking device is preferably effected as a result of arranging the at least one second pin in a linear guide, in particular in a groove or recess of the locking device.

In a preferred manner, the at least one second pin is moved by means of the same actuating device as the at least one first pin. As a result, locking and bracing of the two telescopic elements with respect to one another is made possible in as simple a manner as possible.

The second resetting force can cooperate directly with the at least one second pin, but preferably acts via the second sliding block indirectly on the at least one second pin by means of the second linearly displaceable plate. In a preferred manner, the second resetting force is realized as a spring, in particular a helical spring. As an alternative to this, the second resetting force can also be realized as a spiral spring or as an elastic element.

A particularly simple conversion of the movement of the actuating device along the first axis into a movement of the at least one second pin along the third axis is made possible by means of the second sliding block.

The furniture item preferably has one single second pin. In particular in the case of furniture items with length-adjustable legs with a round cross section, this enables the telescopic elements to be braced in a particularly flexible and sturdy manner. As an alternative to this, however, several second pins can also be used for bracing.

In a particularly preferred manner, the first sliding block is realized as a first plate which is movable along the first axis and on which a first groove is realized. A first journal which is arranged on the first pin is guided in said first groove.

The second sliding block is preferably realized as a second groove which is inserted in a second plate which is movable in a linear manner along the first axis. A second journal, which is arranged on the at least one second pin, is guided in said second groove.

The combination of groove and journal enables a particularly simple development of the sliding block(s).

In a preferred manner, the second sliding block is realized as a curve, wherein said curve is developed in such a manner that when the at least one second pin moves from the second state into the first state, the curve initially comprises a first region with a greater gradient than in the second, following region.

As a result of said development, the at least one second pin can initially be moved relatively quickly along the third axis by means of the greater gradient until it comes into contact with the inside surface of the wall of the first telescopic element. As a result of the following, smaller gradient of the curve, the at least one second pin is then pressed at a lesser movement speed, therefore at a greater force further against the inside surface of the wall in order to enable the bracing of the two telescopic elements. At the same time, as a result of the development of the curve with the two regions with different gradients, self-locking of the second journal in the second groove can be achieved.

The term "gradient" is to be understood in the sense of the present application as the angle which the curve of the second sliding block assumes relative to the first axis. The greater said angle, the greater the gradient of the curve.

In a preferred manner, the actuating device has a driver which, when the actuating device moves from the locked position into the unlocked position, abuts against a stop surface of the second plate.

When the actuating device moves from the locked into the unlocked state in the first direction along the first axis, the drive abuts against the stop surface of the first plate. As a result, the second sliding block is pulled by the actuating device into the first direction, as a result of which a movement of the second journal and consequently of the at least one second pin is effected from the first state into the second state.

Where the actuating device moves from the unlocked to the locked position in a second direction which is opposite the first direction, the drive can be released from the stop surface and consequently move the actuating device further in the second direction than the second plate. As a result, it is possible to uncouple, at least in part, the movement of the at least one first pin, which is preferably also moved by means of the said same actuating device, from the second into the first position by the movement of the at least one second pin from the second state into the first state.

As a second resetting force acts on the at least one second pin, it is also acted upon with a sufficiently high force without contact with the driver of the actuating device in order to enable the two telescopic elements to be braced together.

The at least one first pin is preferably also connected to the actuating device by means of a stop surface.

The locking device is preferably arranged inside the second telescopic element, wherein in a wall of the second telescopic element at least one opening is provided through which the at least one second pin can move.

As a result of the arrangement of the locking device inside the second telescopic element, a particularly compact design of the at least one length-adjustable leg can be achieved. In addition, the two telescopic elements are able to be braced together particularly well as a result.

An opening can preferably also be provided in the wall for the at least one first pin so that said at least one first pin can enter into a force-fitting or form-fitting connection with the first telescopic element through the wall of the second telescopic element.

In a preferred manner, the actuating device is realized as a Bowden cable. As a result, the actuating device can be developed in as simple a manner as possible. In particular, a Bowden cable can also be diverted by means of rollers or the like, for example in order to be able to arrange a lever designed for actuating the Bowden cable outside the at least one leg, in particular below a table top.

At least one sliding bearing, which interacts with a wall on an outside surface of the second telescopic element, is preferably arranged in a region of a first end of the first telescopic element on the inside surface of the wall.

As a result of the arrangement of a sliding bearing, the at least one length-adjustable leg can be realized in a particularly narrow manner, which bestows an overall responsive, aesthetic effect on the furniture item.

In a particularly preferred manner, the first end of the first telescopic element is the top end thereof. In said case, the first telescopic element provides the bottom part and the second telescopic element provides the top part of the at least one length-adjustable leg.

In a preferred manner, the second telescopic element comprises on a second end at least one rolling bearing which interacts with the inside surface of the wall of the first telescopic element.

In a particularly preferred manner, at least two rollers which are situated on opposite sides of the second telescopic element are used as rolling bearings. Said rollers are arranged in such a manner that the outside surfaces thereof touch the inner wall of the first telescopic element at at least one point. The at least two rollers consequently roll along the inside surface of the wall.

In a further preferred manner, the rolling bearing is arranged on the locking device.

The second telescopic element is preferably arranged in such a manner in the first telescopic element that the second end of the second telescopic element lies in the first direction along the first axis below the first end of the first telescopic element. As a result, the second telescopic element is mounted at its second end inside the first telescopic element so as to be linearly displaceable by means of a rolling bearing as well as in a region which lies in the first direction above the rolling bearing by means of a sliding bearing.

At least one arm, which extends from a second end to the first end of the first telescopic element, is arranged inside the first telescopic element, wherein the at least one first pin interacts in a force-fitting or form-fitting manner with the arm in the first position.

As a result of the arrangement of an arm inside the first telescopic element, the surface with which the at least one first pin interacts in a force-fitting or form-fitting manner, can be present separated from the inside surface of the wall of the first telescopic element. As a result, an obstruction of the linear displacement of the second telescopic element inside the first telescopic element is prevented by said surface.

In a particularly preferred manner, the arm projects at least in part into an interior of the second telescopic element. As a result, a guide which interacts with the arm, can be arranged inside the second telescopic element in order to enable particularly good linear guiding of the second telescopic element inside the first telescopic element. The guiding is realized in particular in the form of at least one guide groove or at least one semi-ring which is mounted so as to be pushable along the arm.

Further advantageous embodiments and feature combinations of the invention are produced from the following description of the detail and from the entirety of the claims.

BRIEF DESCRIPTION OF THE DRAWINGS

The drawings used to explain the exemplary embodiment are as follows.

In principle, identical parts in the Figures are provided with identical references.

WAYS TO CARRY OUT THE INVENTION

Figure 1:
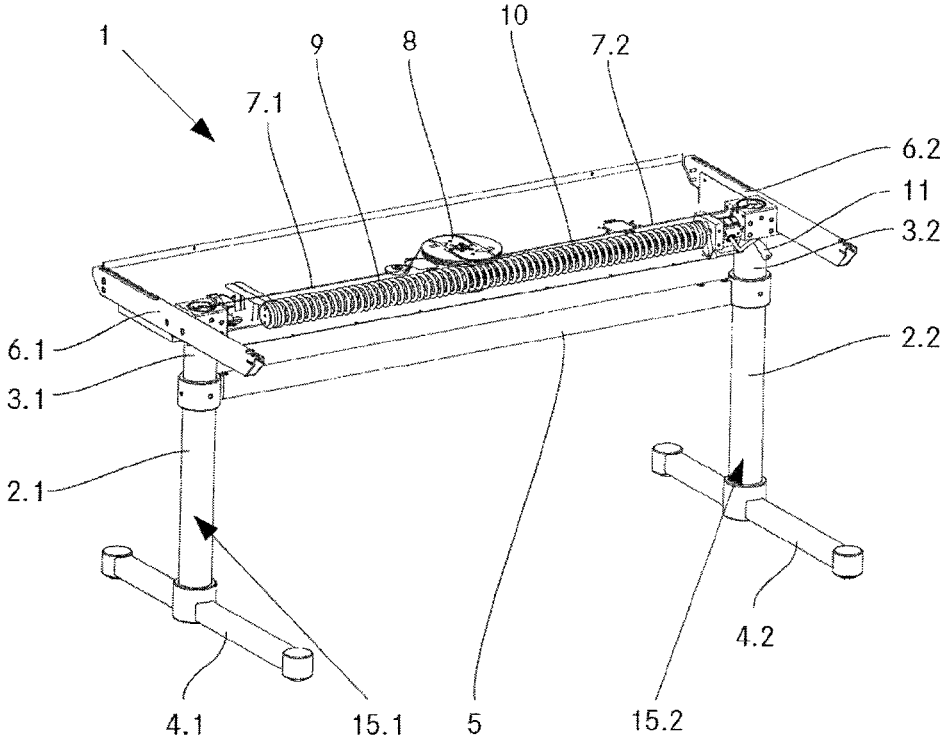
FIG. 1 shows a table according to the invention with two length-adjustable legs.

FIG. 1 shows a furniture item according to the invention in an embodiment as a table 1 with two length-adjustable legs 15.1, 15.2. The two length-adjustable legs 15.1, 15.2 each include a first telescopic element 2.1, 2.2 and a second telescopic element 3.1, 3.2 which is received inside the first telescopic element 2.1, 2.2 and is mounted so as to be linearly displaceable. Arms 4.1, 4.2 are arranged on a bottom end of the first telescopic elements 2.1, 2.2. The arms 4.1, 4.2 increase the stability of the table 2 in relation to the base on which the table 1 stands. The two length-adjustable legs 15.1, 15.2 are connected together by means of a cross member 5 in an upper region of the first telescopic element 2.1, 2.2.

Two members 6.1, 6.2, on which a table top (not shown) can be mounted, are arranged in the region of an upper end of the second telescopic elements 3.1, 3.2. An adjusting mechanism, by way of which the second telescopic elements 3.1, 3.2 can be displaced in a linear manner in relation to the first telescopic elements 2.1, 2.2, is arranged between said members 6.1, 6.2 and below the table top. Said adjusting mechanism has a drive pulley 8 about the circumference of which two wires 7.1, 7.2 can be wound. The wires 7.1, 7.2 are deflected by corresponding rollers and guided into the length-adjustable legs 15.1, 15.2. As a result of winding the wires 7.1, 7.2 about the drive pulley 8, the table top can be positioned higher using the adjusting mechanism shown. Correspondingly, unwinding the wires 7.1, 7.2 causes the table top to be lowered.

The specific weight of the table top is compensated for by a counterweight spring 9. This allows the height of the table to be adjusted in a relatively smooth-running manner. The counterweight spring preferably has an adjusting arrangement by way of which the force exerted by the counterweight spring 9 can be modified by means of lengthening or shortening the counterweight spring 9. Said adjusting arrangement has a hand crank 11 by way of which the length of the counterweight spring 9 can be adjusted by means of a spindle 10 in order to enable different preliminary tensions of the counterweight spring 9 for compensating for the specific weight. The drive pulley 8 with the wires 7.1, 7.2 is fastened on the counterweight spring 9.

Figure 2:
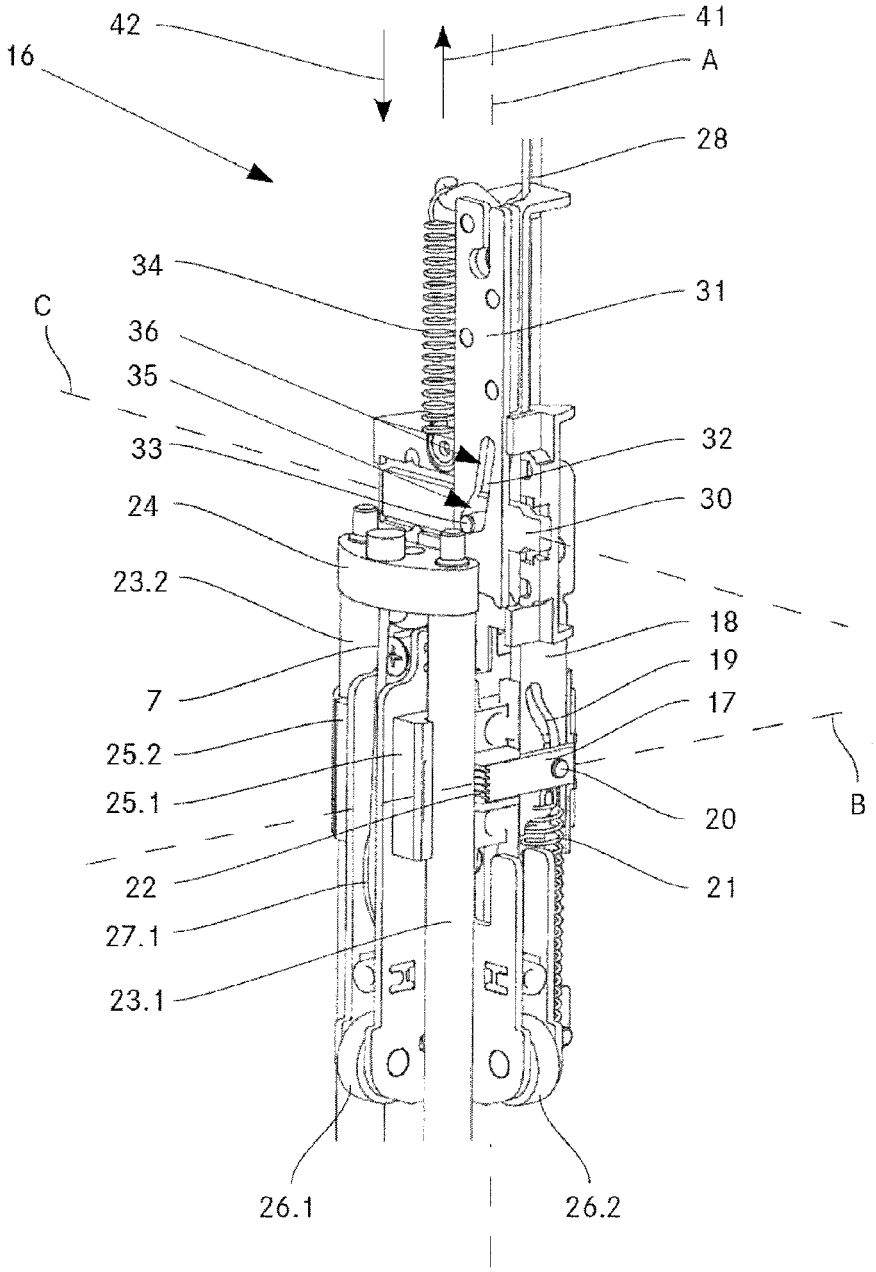
FIG. 2 shows a three-dimensional view of an embodiment of a locking device.

FIG. 2 shows a three-dimensional view of a locking device 16 which interacts with two arm pins 23.1, 23.2 of an arm of the first telescopic element 2. The two arm pins 23.1, 23.3 are connected together at the upper end thereof by means of a connecting element 24. A wire of an adjusting mechanism is connected to the connecting element 24. The wire 7 is initially guided parallel to the arm pins 23.1, 23.3 to a guide roller 27. The wire 7 is turned about 180° by means of said guide roller 27 and is then guided parallel to a wall of the second telescopic element (not shown) through said second telescopic element to the adjusting mechanism.

The first telescopic element 2 and the second telescopic element 3 are not shown in this Figure for representational reasons. The locking device 16 is arranged on the second, lower end of the second telescopic element 3. The locking device 16 is guided along the two arm pins 23.1, 23.2 by means of two guide clamps 25.1, 25.2. In addition, four rollers, of which only two rollers 26.1, 26.2 can be seen in the Figure, are arranged on the lower end of the locking device 16. The locking device 16 is guided so as to be linearly displaceable inside the second telescopic element 3 by means of the rollers 26.1, 26.2.

A first pin 17 is arranged so as to be linearly displaceable between a first and a second position in the locking device 16. A movement of the first pin 17 from the first into the shown, second position is made possible as a result of the movement of an actuating device 28, which is realized in the embodiment shown as a Bowden cable, in a first direction 33 along a first axis A. The actuating device 28 is connected to a first first plate 18 which is mounted so as to be linearly displaceable in the direction A. The first plate 18 has a first sliding block 19 which is realized as a groove. A first journal 20 which is connected to the first pin 17 is guided in the sliding block 19. A movement of the first plate 18, which is triggered by the actuating device 28, is converted by said first sliding block 19 into a linear movement of the first pin 17 along a second axis B which is at right angles to the first axis A. The first sliding block 19 is realized as a curve in the embodiment shown.

A first spiral spring 21, which exerts a resetting force in opposition to the first direction 33 onto the first plate 18 in a second direction 34 which is opposite the first direction 33, cooperates with the first plate 18. As a result of said resetting force, the first pin 17—in so far as no force is exerted by the actuating device 28 in the first direction 33 onto the first plate 18—is acted upon by means of the first sliding block 19 with a force which presses it into the first position. In said first position, the first pin engages by way of a surface 22 with form-fitting elements on the first arm pin 23.1. The first arm pin 23.1 has complementary form-fitting elements (not shown) such that a form-fitting connection is produced between the first pin 17 and the first arm pin 23.1. A movement of the first pin 17 and consequently of the entire locking device 16 along the first axis A is prevented as a result of said form-fitting connection.

A second pin 30 is mounted in the locking device 16 so as to be linearly displaceable along a third axis C. A linear movement of a second plate 31 along the first axis A is converted into the linear movement of the second pin 30 along the third axis C by means of a second sliding block 32, into which a second journal 33 is connected to the second pin 30. In the Figure, the second pin 30 is situated in a second state where the second pin 30 is at a spacing from an inside wall of the first telescopic element 2 (not shown). As a result of a movement along the third axis C, the second pin 30 can be moved into a second state where the second pin 30 pressed onto the inside wall of the first telescopic element 2. As a result, bracing between the two telescopic elements 2, 3 is achieved.

A second resetting force is exerted onto the second plate 31 by means of a second spiral spring 34 which cooperates with the second plate 31. As a result of said second resetting force, the second pin 30—in so far as no force is exerted in the first direction 33 by the actuating device 28—is pressed into the second position. In addition, said second resetting force strengthens the bracing of the two telescopic elements 2, 3, as the pressing force of the second pin 30 onto the inside wall of the first telescopic element is strengthened by the second spiral spring 34.

The second sliding block 32 is realized as a groove. The groove is developed as a curve which comprises a greater gradient in a first region 35 than in a second region 36. A gradient is to be understood in each case as the angle which is enclosed between a side edge of the groove and the first axis A. In this case, the curve is realized in such a manner that the transition between the first region 35 and the second region 36 lies at the point where the second journal 33 is situated at the moment at which the second pin 30 comes into contact with the inside wall of the first telescopic element 2. As a result of the subsequent smaller gradient in the second region 36, the movement of the second pin 30 is effected at a lesser speed, therefore at more force, as a result of which particularly efficient bracing of the two telescopic elements 2, 3 is made possible by the second pin 30. In addition, this type of development of the second sliding block 32 also comprises a self-locking of the journal 33 as soon as the two telescopic elements 2, 3 are braced against one another by means of the second pin 30.

Figure 3:
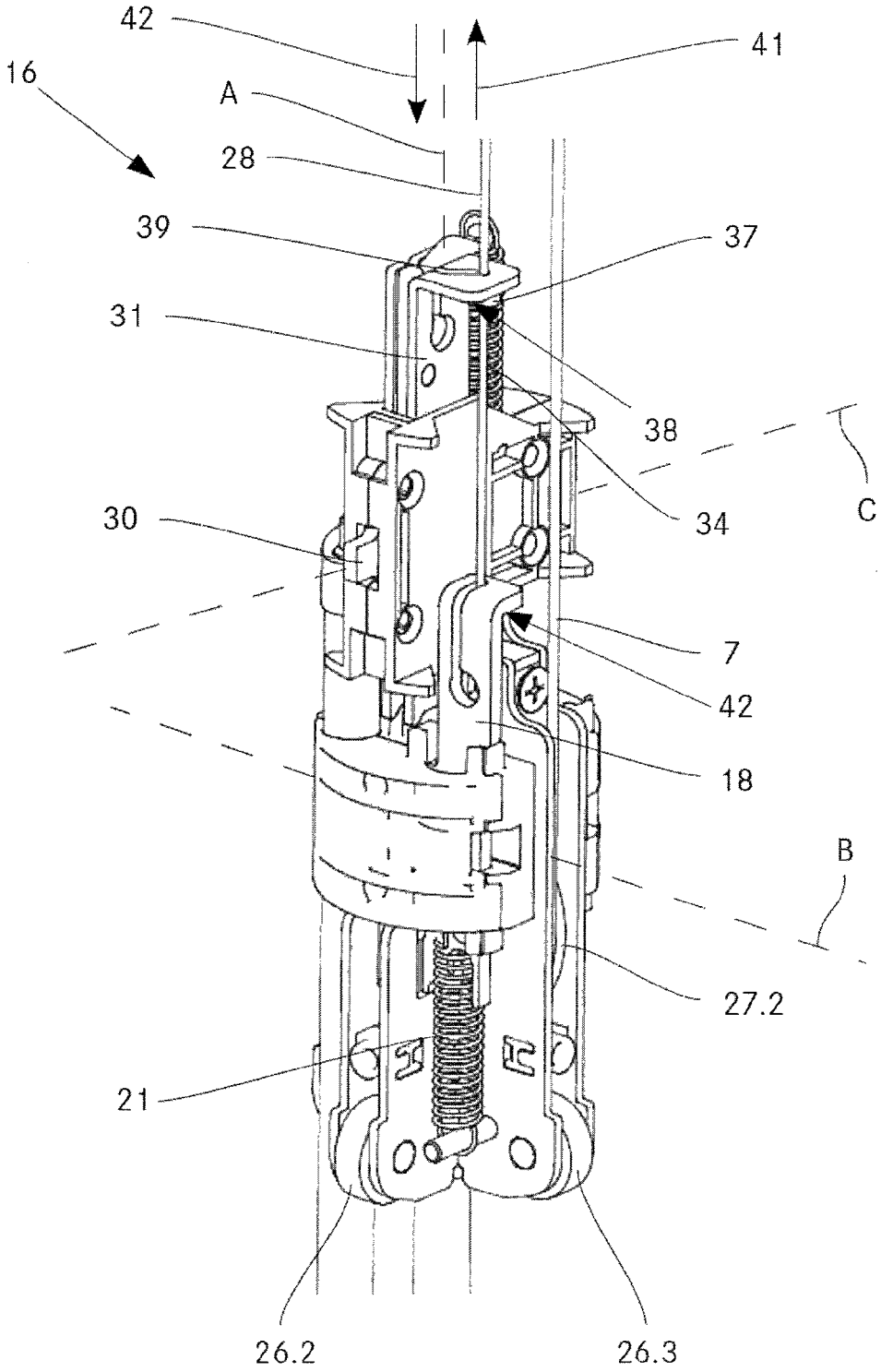
FIG. 3 shows the embodiment of the locking device of FIG. 2 rotated by 90°.

FIG. 3 shows the embodiment of the locking device 16 shown in FIG. 2 rotated by 90° about the axis A. In addition, corresponding covers of the locking device 16 are shown in said Figure.

The fastening of the actuating device 28 to the linearly movable second plate 31 can be seen in said Figure. The second plate 31 has a region, which is angled by 90° in relation to the rest of the second plate 31, with an opening 39 through which the actuating device 28, realized as a Bowden cable, is passed. The bottom side of the angled region forms a second stop surface 38 against which a second driver 37, which is arranged on the actuating device 28, abuts when the actuating device 28 is moved in the first direction 33. As a result of the second driver 27 not being fixedly connected to the angled region of the second plate 31, the actuating device 28 is able to move freely in the second direction 34. As a result, the first plate 18 can be moved further in the second direction than the second plate 31. The first plate 18 is additionally connected in the same manner to the actuating device 28 by means of a first driver 41, which abuts against a first stop surface 42 of the first plate 18 when the actuating device 28 is moved in the first direction 33. As a result, both plates 18, 31, with the actuating device 28 released, can be moved freely as a result of the first spiral spring 21 or as a result of the second spiral spring 34 into the first position or rather into the first state.

Figure 4:
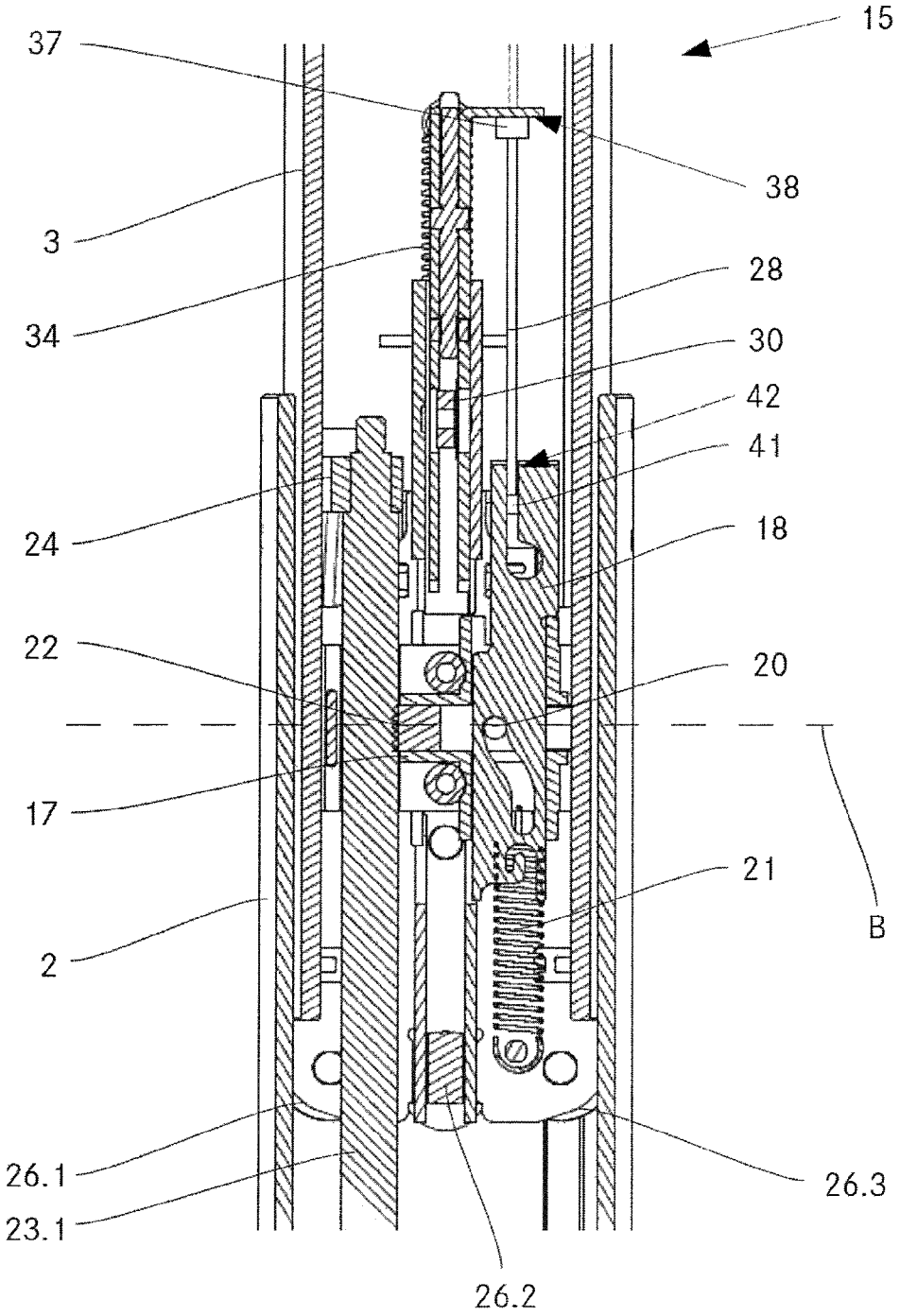
FIG. 4 shows a sectional drawing of an embodiment of a locking device.

FIG. 4 shows a section through a length-adjustable leg 15 according to the present invention along the first axis A. The sectional plane lies in the direction of the second axis B. In contrast to FIGS. 2 and 3, the first pin 17 is situated in the first position, i.e. it engages in a form-fitting manner on a surface of the first arm pin 23.1. A correspondingly developed surface 22 with form-fitting elements is situated at the tip of the first pin 17. As can be seen in said Figure, said surface 22 in the embodiment shown is realized on a plug inserted in the first pin 17.

The overlap between the second telescopic element 3 and the first telescopic element 2, which is created as a result of the second telescopic element 3 being received into the first telescopic element, is easy to see in said Figure. In the configuration shown, a state with a minimum overlap between the two telescopic elements 2, 3 is shown, i.e. the state in which the length-adjustable leg 15 comprises the greatest length. Once again three of the total of four rollers 26.1, 26.2, 26.3, by way of which the second telescopic element 3 is mounted so as to be linearly displaceable in the first telescopic element 2, can be seen on the bottom second end of the second telescopic element.

Figure 5:
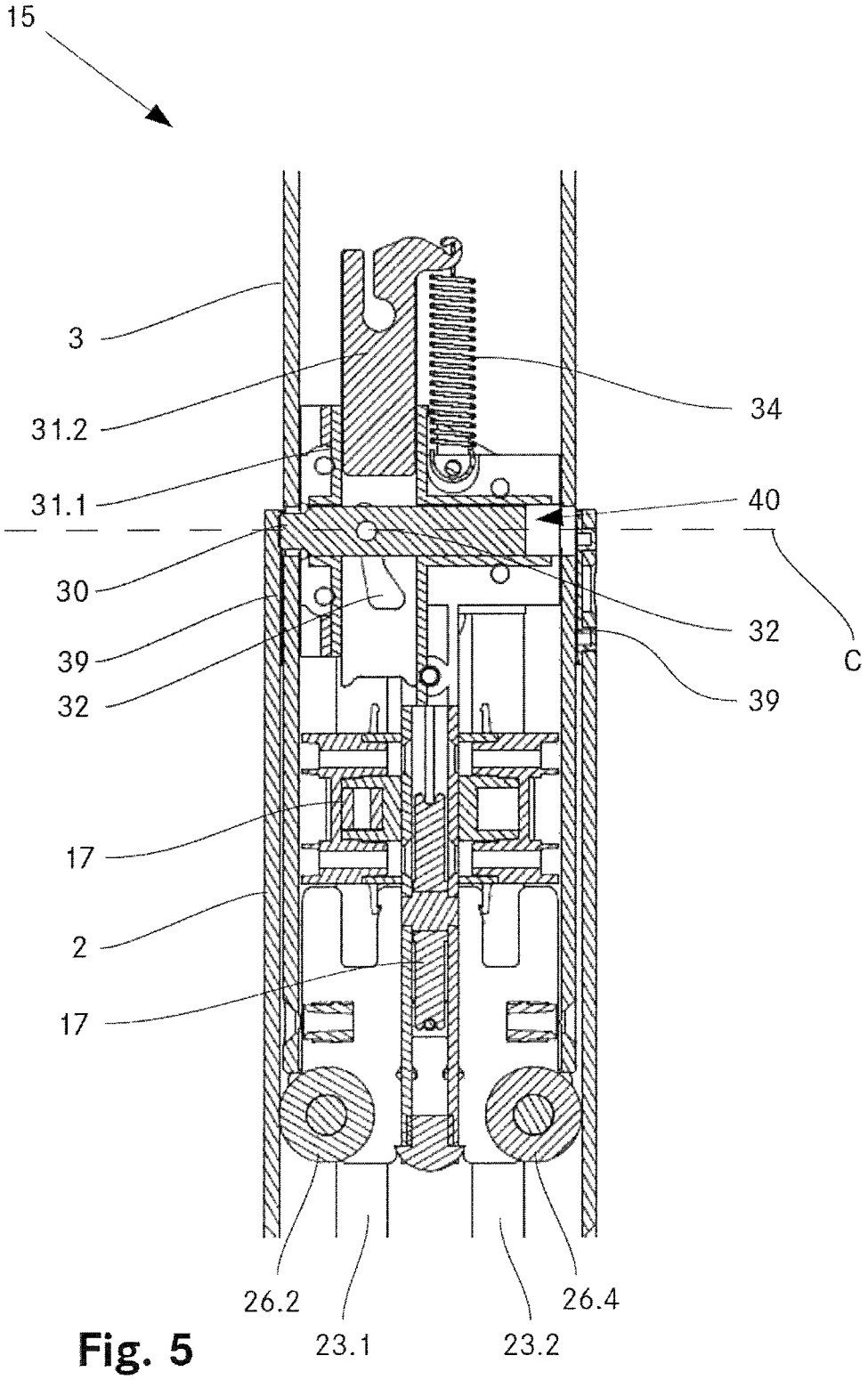
FIG. 5 shows a sectional drawing of the embodiment of the locking device of FIG. 4 rotated by 90°.

FIG. 5 shows a further sectional drawing of the length-adjustable leg 15 according to FIG. 4, but rotated by 90° about the first axis A. In contrast to FIG. 4, the arrangement of the second pin 30 is easy to see on said representation. The second pin 30 is arranged inside a linear guide 40 which permits the movement of the second pin 30 along the third axis C. The second plate 31 consists of three elements, two elements 31.1, 31.2 of which can be seen on the Figure. The top element 31.2 is inserted into a holder which is assembled from two bottom elements 31.1. The second linear guide 32 in which the second journal 32 is guided, is also inserted in the bottom elements 31.1.

Together with the rollers, of which only two rollers 26.2, 26.4 are visible on the Figure, the sliding bearing 39, which is mounted on the inside wall of the first telescopic element 2, can also be seen on said Figure. The second telescopic element 3 is mounted so as to be linearly displaceable inside the first telescopic element 2 by means of the rollers 26.2, 26.4 and the sliding bearing 39.

The invention claimed is:

1. A furniture item having at least one length-adjustable leg, wherein the length-adjustable leg includes the following:

a) a first telescopic element which is realized as a hollow body, b) a second telescopic element which is mounted inside the first telescopic element so as to linearly displaceable along a first axis, c) a locking device which is arranged on the second telescopic element and comprises a first pin which is movable using an actuating device from a first position, in which the first pin prevents the movement of the first telescopic element relative to the second telescopic element as a result of a force-fitting connection or form-fitting connection between said first pin and said first telescopic element, into a second position in which the displacement is not prevented, wherein the locking device has at least one second pin which is movable by the actuating device from a first state, where the second pin is pressed against an inside surface of a wall of the first telescopic element in order to brace the second telescopic element in relation to the first telescopic element, and a second state where the second pin is at a spacing from the wall of the first telescopic element.

2. The furniture item according to claim 1, wherein the first pin is mounted in the locking device in such a manner that it is movable along a second axis which is at right angles to the first axis, wherein a movement of the actuating device in opposition to a first resetting force into a first direction along the first axis from a locked position into an unlocked position is converted using a first sliding block into a movement of the first pin along the second axis from the first position to the second position.

3. The furniture item according to claim 1, wherein the second pin is mounted in the locking device in such a manner that that it is movable along a third axis which is at right angles to the first axis, wherein a movement of the actuating device in opposition to a second resetting force, which acts on the second pin, from the locked position into the unlocked position is converted using a second sliding block into a movement of the second pin along the third axis from the first state to the second state.

4. The furniture item according to claim 3, wherein the second sliding block is realized as a second groove which is inserted in a second plate which is movable in a linear manner along the first axis, in which groove is guided a second journal which is arranged on the second pin.

5. The furniture item according to claim 4, wherein the second sliding block is present as a curve, wherein the curve is developed in such a manner that when the second pin moves from the second state into the first state, the curve initially comprises a greater gradient in a first region than in a subsequent second region.

6. The furniture item according to claim 4, wherein the actuating device has a second driver which, when the actuating device moves from the locked position into the unlocked position, abuts against a second stop surface of the second plate.

7. The furniture item according to claim 1, wherein the locking device is arranged inside the second telescopic element, and wherein in a wall of the second telescopic element at least one opening is provided through which the second pin can move.

8. The furniture item according to claim 1, wherein the actuating device is realized as a Bowden cable.

9. The furniture item according to claim 1, wherein at least one sliding bearing, which interacts with a wall on the outside surface of the second telescopic element, is arranged in a region of a first end of the first telescopic element on the inside surface of the wall.

10. The furniture item according to claim 1, wherein the second telescopic element comprises on a second end at least one rolling bearing which interacts with the inside surface of the wall of the first telescopic element.

11. The furniture item according to claim 1, wherein at least one arm, which extends from a second end to the first end of the first telescopic element, is arranged inside the first telescopic element, wherein the first pin interacts in a force-fitting or form-fitting manner with the arm in the first state.

12. The furniture item according to 2, wherein the second pin is mounted in the locking device in such a manner that that it is movable along a third axis which is at right angles to the first axis, wherein a movement of the actuating device in opposition to a second resetting force, which acts on the second pin, from the locked position into the unlocked position is converted using a second sliding block into a movement of the second pin along the third axis from the first state to the second state, and the third axis is at right angles to the second axis.

* * * * *